US008238764B2

(12) United States Patent
Funahashi

(10) Patent No.: US 8,238,764 B2
(45) Date of Patent: Aug. 7, 2012

(54) IMAGE FORMING APPARATUS AND DEVELOPMENT CARTRIDGE IN WHICH INFORMATION STORED ON THE DEVELOPMENT CARTRIDGE CAN BE READ BY THE IMAGE FORMING APPARATUS

(75) Inventor: Norimichi Funahashi, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 484 days.

(21) Appl. No.: 12/391,287

(22) Filed: Feb. 24, 2009

(65) Prior Publication Data

US 2009/0220250 A1 Sep. 3, 2009

(30) Foreign Application Priority Data

Feb. 29, 2008 (JP) ..... 2008-050493

(51) Int. Cl.
*G03G 15/00* (2006.01)

(52) U.S. Cl. ..... 399/12; 399/13

(58) Field of Classification Search ..... 399/12, 399/13, 118, 111

See application file for complete search history.

(56) References Cited

U.S. PATENT DOCUMENTS

| | | | | |
|---|---|---|---|---|
| 6,038,417 | A * | 3/2000 | Nagamine et al. | |
| 6,252,619 | B1 * | 6/2001 | Ueda et al. | |
| 6,324,350 | B1 * | 11/2001 | Ito et al. | 399/12 |
| 6,922,534 | B2 | 7/2005 | Goto et al. | |
| 7,110,684 | B2 | 9/2006 | Isobe et al. | |
| 7,369,783 | B2 | 5/2008 | Kikuchi | |
| 2006/0182465 | A1 | 8/2006 | Funamoto et al. | |
| 2006/0263107 | A1 * | 11/2006 | Inukai et al. | 399/27 |
| 2007/0297814 | A1 | 12/2007 | Kasai | |
| 2008/0180215 | A1 * | 7/2008 | Mott | |
| 2009/0184817 | A1 * | 7/2009 | Ishizuka | |

FOREIGN PATENT DOCUMENTS

| | | | |
|---|---|---|---|
| CN | 1217244 | | 8/2005 |
| EP | 1326144 | | 8/2002 |
| JP | 03-261964 | | 11/1991 |
| JP | 08-185008 | | 7/1996 |
| JP | 2001-318573 | | 11/2001 |
| JP | 2002-006695 | | 1/2002 |
| JP | 2002318510 | A * | 10/2002 |
| JP | 2003-029490 | | 1/2003 |

(Continued)

OTHER PUBLICATIONS

Office Action in counterpart JP Application No. 2008-046155, mailed Feb. 23, 2010.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming apparatus is provided. A development cartridge having a first memory storing therein cartridge information is detachably mountable to the image forming apparatus. The image forming apparatus includes: an apparatus casing and an exposure unit having plural light emitting portions. The exposure unit is supported by the apparatus casing so that the light emitting portions face a photosensitive member rotatably supported by the apparatus casing. The image forming apparatus further includes a reader unit disposed on the exposure unit and configured to read the cartridge information from the first memory when the development cartridge is mounted to the image forming apparatus.

9 Claims, 9 Drawing Sheets

FOREIGN PATENT DOCUMENTS

| | | | | |
|---|---|---|---|---|
| JP | 2003-122178 | | | 4/2003 |
| JP | 2003-177652 | | | 6/2003 |
| JP | 2003-271021 | | | 9/2003 |
| JP | 2004-167728 | | | 6/2004 |
| JP | 2005-077612 | | | 3/2005 |
| JP | 2005-134799 | | | 5/2005 |
| JP | 2005-145006 | | | 6/2005 |
| JP | 2005286526 | A | * | 10/2005 |
| JP | 2005345587 | A | * | 12/2005 |
| JP | 2005349670 | A | * | 12/2005 |
| JP | 2006058743 | A | * | 3/2006 |
| JP | 2006-208916 | | | 8/2006 |
| JP | 2007-047471 | | | 2/2007 |
| JP | 2007-052055 | | | 3/2007 |
| JP | 2007-272130 | | | 10/2007 |

OTHER PUBLICATIONS

Office Action in corresponding Chinese Application No. 200910119127.4, dated Aug. 9, 2010.

Office Action in corresponding JP Application No. 2008-050493, mailed Feb. 25, 2010.

Search Report for European Application No. 09002208.8 dated Jun. 17, 2009.

* cited by examiner

IMAGE FORMING APPARATUS AND DEVELOPMENT CARTRIDGE IN WHICH INFORMATION STORED ON THE DEVELOPMENT CARTRIDGE CAN BE READ BY THE IMAGE FORMING APPARATUS

CROSS REFERENCE TO RELATED APPLICATION

The present disclosure relates to the subject matter contained in Japanese patent application No. 2008-050493 filed on Feb. 29, 2008, which is expressly incorporated herein by reference in its entirety.

TECHNICAL FIELD

The present invention relates to an image forming apparatus. The present invention also relates to a development cartridge detachably mountable to the image forming apparatus.

BACKGROUND ART

As disclosed, for example, in JP2007-52055A, an electrophotographic image forming apparatus, such as a laser printer, can be configured to have a replaceable development cartridge having a memory (IC chip). When the development cartridge is mounted on the printer, the printer can read information from the memory for printing control. For example, the development cartridge memory stores information indicative of whether or not the development cartridge is brand-new, and an antenna on the printer reads the information stored in the memory so that a rotating speed of a development roller is varied based on the information.

As the electrophotographic image forming apparatus, two types are available, i.e. a laser type image forming apparatus and a non-laser type image forming apparatus. The non-laser type image forming apparatus has an exposure unit that exposes a photosensitive member using light emitted from LEDs or the like without using laser light. In case of the non-laser type image forming apparatus, the exposure unit has to be disposed closer to the photosensitive member because of light intensity limitation. Therefore, high accuracy regarding the positional relationship between the exposure unit and the photosensitive member is required. The development cartridge can be configured so that the development cartridge along with the photosensitive member is attached to and detached from the image forming apparatus. Alternatively, the development cartridge can be configured to be attached to and detached from the printer with the photosensitive member remaining in the image forming apparatus. In either of the cases, it is required to attach and detach the development cartridge without adversely affecting the positional relationship between the exposure unit and the photosensitive member.

SUMMARY

As one of illustrative, non-limiting embodiments, the present invention can provide an image forming apparatus, to which a development cartridge having a first memory storing therein cartridge information is detachably mountable. The image forming apparatus includes: an apparatus casing and an exposure unit having plural light emitting portions. The exposure unit is supported by the apparatus casing so that the light emitting portions face a photosensitive member rotatably supported by the apparatus casing. The image forming apparatus further includes a reader unit disposed on the exposure unit and configured to read the cartridge information from the first memory when the development cartridge is mounted to the image forming apparatus.

As one of advantages, the present invention can maintain accuracy of reading information from the first memory disposed on the development cartridge. As another one of advantages, the present invention can secure a positional relationship between the exposure unit and the photosensitive member. As yet another one of the advantages, the present invention can improve detachability of the development cartridge.

These and other advantages of the present invention will be discussed in detail with reference to the accompanying drawings.

DESCRIPTION OF THE PREFERRED EMBODIMENT

Embodiment 1

A description is given of embodiment 1 of the present invention with reference to FIG. 1 through FIG. 6.

1. Entire Configuration of Printer

Figure 1:
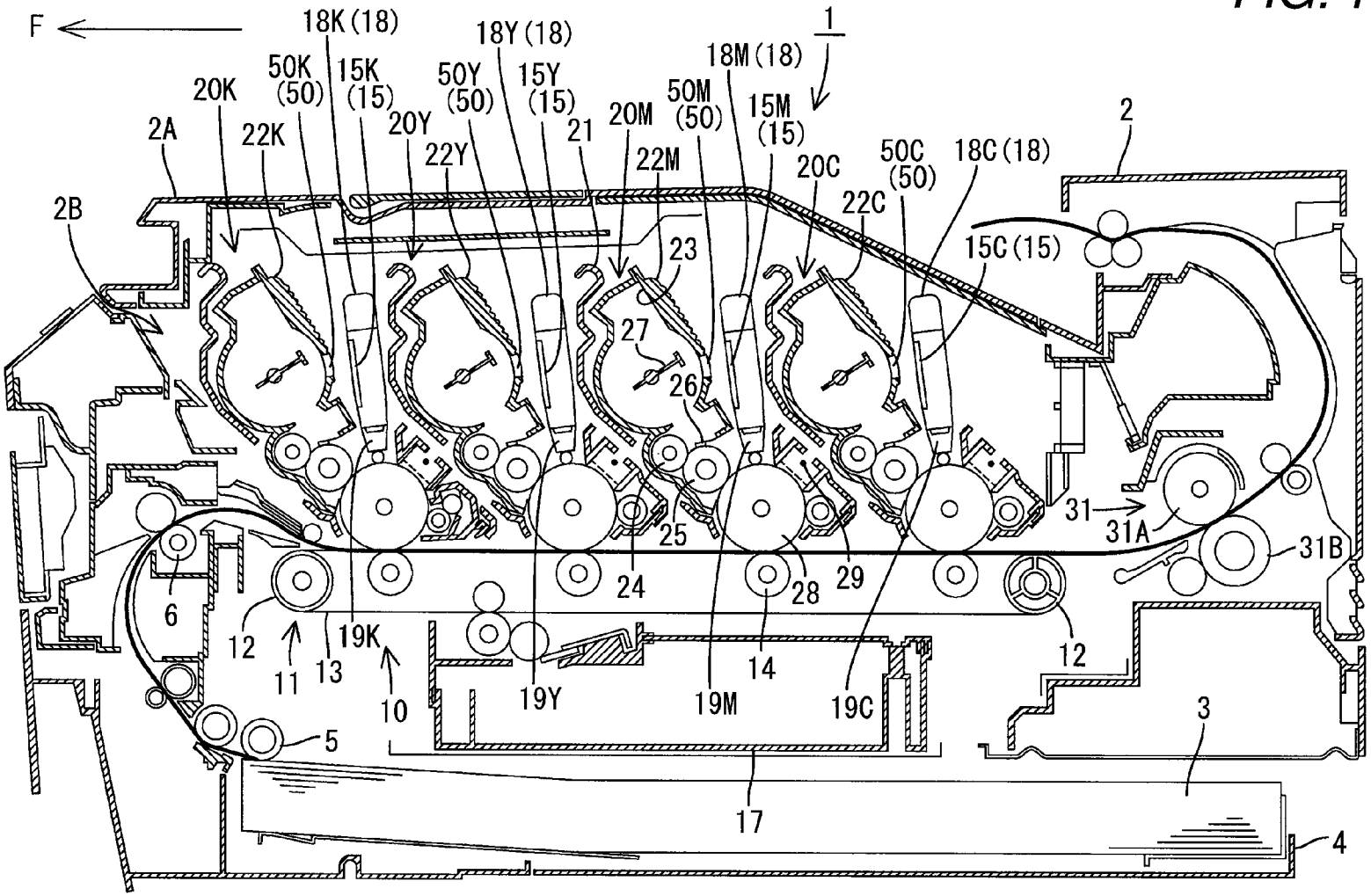
FIG. 1 is a side sectional view (when the cover is closed) showing a brief configuration of a printer according to Embodiment 1.
Figure 2:
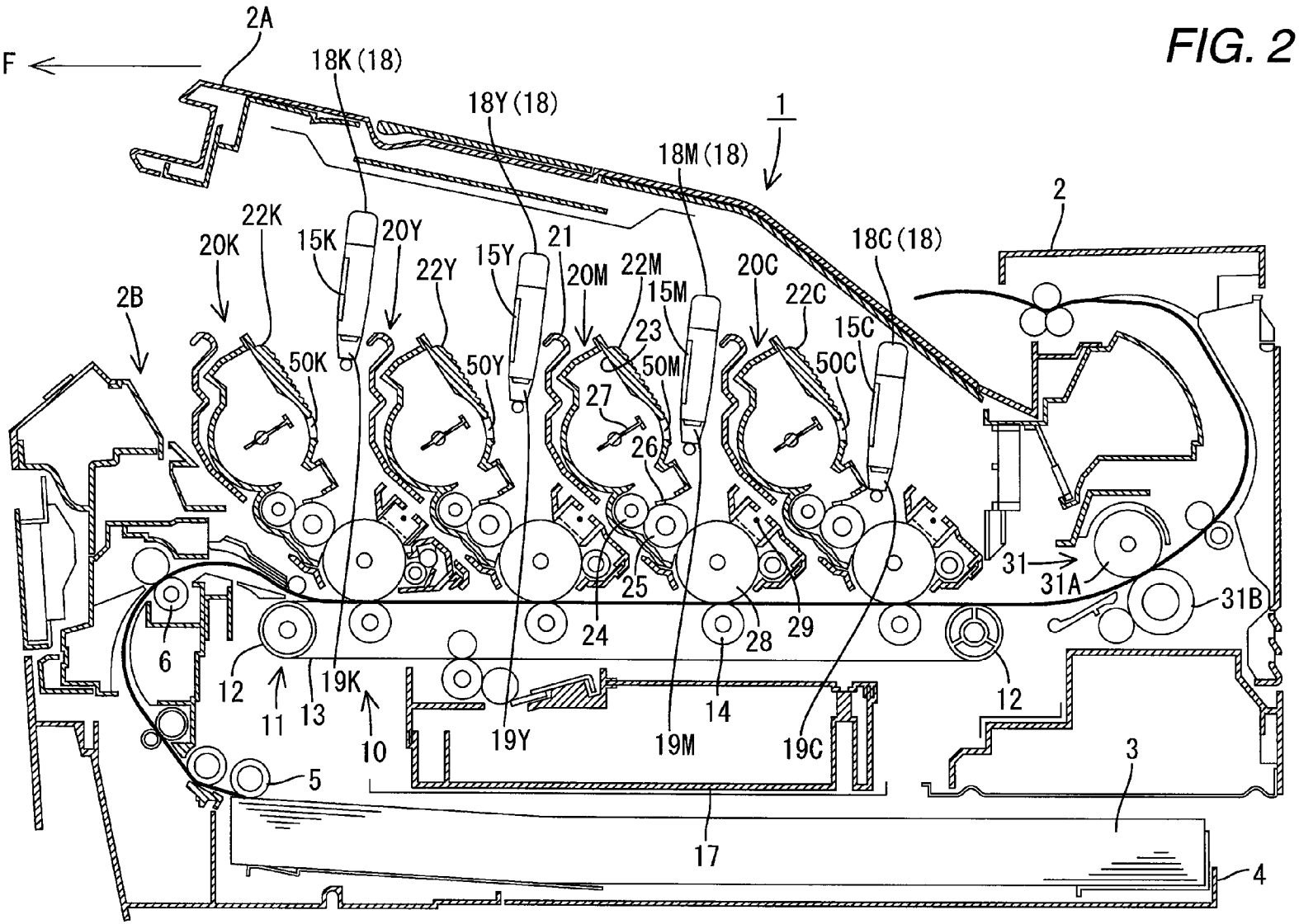
FIG. 2 is a side sectional view (when the cover is opened) showing a brief configuration of the printer.

FIG. 1 and FIG. 2 are side sectional views showing a brief configuration of a printer 1 (one example of an image forming apparatus) according to the present embodiment. In the following description, the left direction of the paper of FIG. 1 and FIG. 2 is the front direction that is shown as F direction in the respective drawings. In this embodiment, the printer 1 is configured as a color printer for forming a color image by four colors of toner (black K, yellow Y, magenta M and cyan C). Hereinafter, where respective components are distinguished color by color, K (black), Y(yellow), M(magenta) and C(cyan) that signify respective colors are added to the end of reference numerals of the components. The image forming apparatus according to the present invention may be configured to use a single color (black) or five or more colors.

The printer 1 includes a casing 2 (one example of an apparatus casing). The casing 2 has an opening portion 2B formed on the upper surface thereof, and an openable cover 2A for blocking the opening portion 2B. A supply tray 4 on which sheets 3 can be stacked as recording media is provided on the bottom part of the casing 2. A feeder roller 5 is provided above the front end of the supply tray 4 to feed an uppermost one of the sheets 3 stacked in the supply tray 4 to a registration roller 6. The registration roller 6 corrects a skew of the sheet 3 and then conveys the sheet 3 to a belt unit 11 of the image forming unit 10.

The belt unit 11 is configured so that an endless belt 13 of polycarbonate, etc., is suspended between front and rear belt supporting rollers 12. When the rear belt supporting roller 12 is driven and rotated, the belt 13 is circulated and moved in the clockwise direction in FIG. 1 to convey a sheet 3 on the upper surface of the belt 13 backward. Transfer rollers 14 are provided inside the belt 13. Each of the transfer rollers 14 is disposed to face a corresponding one of photosensitive members 28 of the processing unit 20 through the belt 13.

A cleaning unit 17 is provided below the belt unit 11 to remove and collect toner and paper powder from the surface of the belt 13.

The exposure unit 18 includes four LED units 18K, 18Y, 18M and 18C corresponding to respective colors of black, yellow, magenta, and cyan. The LED units 18 are supported on the underside of the cover 2A by supporting members 56 (refer to FIG. 4 described later), and have LED heads 19K, 19Y, 19M and 19C at the lower end parts thereof. Each of the LED heads 19K, 19Y, 19M and 19C includes plural light emitting elements arrayed in one row in the left and right direction. In this embodiment, an LED 70 (one example of a light emitting portion, see FIG. 6)) is used as each light emitting element. The light emitting elements are controlled based on image data to irradiate and expose the surface of the photosensitive member 28.

The processing unit 20 includes four process cartridges 20K, 20Y, 20M and 20C corresponding to the four colors. The process cartridge 20K, 20Y, 20M, 20C includes a cartridge frame 21 and a development cartridge 22K, 22Y, 22M, 22C detachably mounted to the cartridge frame 21. As shown in FIG. 2, when the cover 2A is opened, the LED units 18K, 18Y, 18M and 18C along with the cover 2A are spaced apart from the process cartridges 20K, 20Y, 20M and 20C, and therefore the process cartridges 20K, 20Y, 20M and 20C are made detachable from the casing 2. In the present embodiment, four sets of forming units are provided by the LED units 18K, 18Y, 18M and 18C, process cartridges 20K, 20Y, 20M and 20C, and transfer rollers 14.

The development cartridge 22 includes a toner accommodation chamber 23 for accommodating toner of a corresponding color as a developer, and further includes a supply roller 24, a development roller 25, a layer thickness regulation blade 26, an agitator, 27, etc. Toner discharged from the toner accommodation chamber 23 is supplied to the development roller 25 by rotation of the supply roller 24, and is positively charged between the supply roller 24 and the development roller 25 by friction. The toner supplied onto the development roller 25 enters between the layer thickness regulation blade 26 and the development roller 25 by rotation of the development roller 25, is further charged here by friction, and is carried on the development roller 25 as a thin layer having a constant thickness.

The photosensitive member 28 and a scorotron type electrifier 29 are provided at the lower part of the cartridge frame 21. The surface of the photosensitive member 28 is covered by a positively chargeable photosensitive layer. When an image is to be formed on a sheet 3, the photosensitive member 28 is driven and rotated so that electrifier 29 positively charges the surface of the photosensitive member 28 uniformly. The exposure unit 18 emits light to expose the positively charged part of the photosensitive member 28 to form an electrostatic latent image corresponding to the image on the surface of the photosensitive member 28.

By rotation of the development roller 25, positively charged toner carried on the development roller 25 is brought into contact with and supplied to the surface of the photosensitive member 28, so that the electrostatic latent image on the surface of the photosensitive member 28 is developed as a visible toner image.

The toner images respectively carried on the surfaces of the photosensitive members 28 are sequentially transferred on the sheet 3 by negative transfer voltage applied to the transfer rollers 14 when the belt 13 conveys the sheet 3 to sequentially pass through transfer positions between the photosensitive members 28 and the transfer rollers 14. The sheet 3 having the toner images transferred thereon is thereafter conveyed to the fixing unit 31.

The fixing unit 31 has a heating roller 31A having a heating source and a pressing roller 31B for pressing the sheet 3 onto the heating roller 31A. The toner image transferred on the sheet 3 is thermally fixed by the fixing unit. The sheet 3 on which the toner image is thermally fixed by the fixing unit 31 is conveyed upward and is discharged onto the upper surface of the cover 2A.

2. Electrical Configuration

Figure 3:
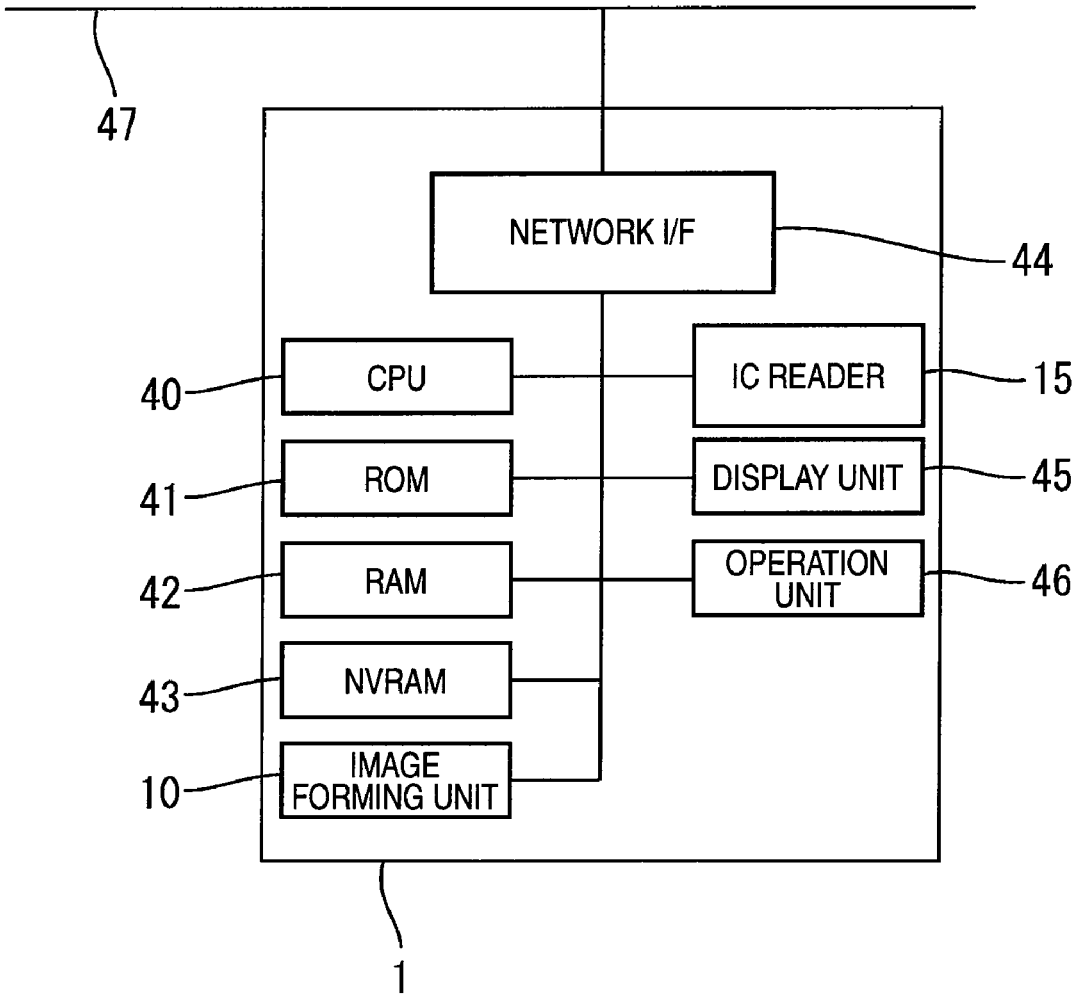
FIG. 3 is a block diagram showing electrical configuration of the printer.

FIG. 3 is a block diagram showing electrical configuration of the printer 1.

As shown in FIG. 3, the printer 1 includes a CPU 40 (one example of a determining unit), a ROM 41, a RAM 42, a NVRAM (non-volatile memory) 43, a network interface 44, the image forming unit 10, an IC reader 15 (one example of the reader unit), a display unit 45 and an operation unit 46, etc., which are connected one another.

The ROM 41 stores programs for executing various types of operations of the printer such as a printing process and a determining process regarding the cover and cartridge, which will be described later The CPU 40 controls portions of the printer according to the programs read from the ROM 41 while storing the processing results in the RAM 42 or NVRAM 43. The network interface 44 is connected to a peripheral computer (not illustrated), etc., via a communication line 47 to enable data transmission between the printer 1 and the peripheral computer, etc.

As shown, for example, in FIG. 1, the printer 1 according to this embodiment is provided with four IC readers 15K, 15Y, 15M and 15C corresponding to the four colors of development cartridges 22K, 22Y, 22M and 22C. Each of the development cartridges 22 has an IC chip 50 (for example, EEPROM, one example of a first memory) storing therein cartridge information. The IC reader 15 can read the cartridge information from the IC chip 50. The "cartridge information" includes, for example, color information of toner accommodated in the development cartridge 22K, 22Y, 22M, 22C and information indicative of whether or not the development cartridge 22K, 22Y, 22M, 22C is brand-new. The IC reader 15 may be configured to not only read information from the IC chip 50 but also write information in the IC chip 50. In this case, the "cartridge information" may be information of operation quantity of the development cartridge 22 (for example, number of sheets having been printed by using the cartridge 22, the number of rotations that the agitator 27 has been rotated, etc.).

3. Guide Mechanism of LED Unit

The printer 1 according to the present embodiment is a non-laser type that exposes the photosensitive member 28 using light emitted from LEDs 70, the light intensity of which is lower than laser light. Therefore, it is required to dispose the LED heads 19 of the LED units 18 closer to the photosensitive members 28, respectively. Further, in order to carry out accurate exposure, high accuracy is required in regard to the positional relationship between each of the LED units 18 and a corresponding one of the photosensitive members 28.

As described above, the printer 1 is designed so that the LED units 18 are supported on the underside of the cover 2A, and when the cover 2A is opened, the LED units 18 are moved along with the cover 2A. Therefore, to establish proper positional relationships between the LED units 18 and the photosensitive members 28 when the cover 2A is closed, the printer 1 is provided with guide mechanisms 52 for guiding the LED units 18, respectively.

Figure 4:
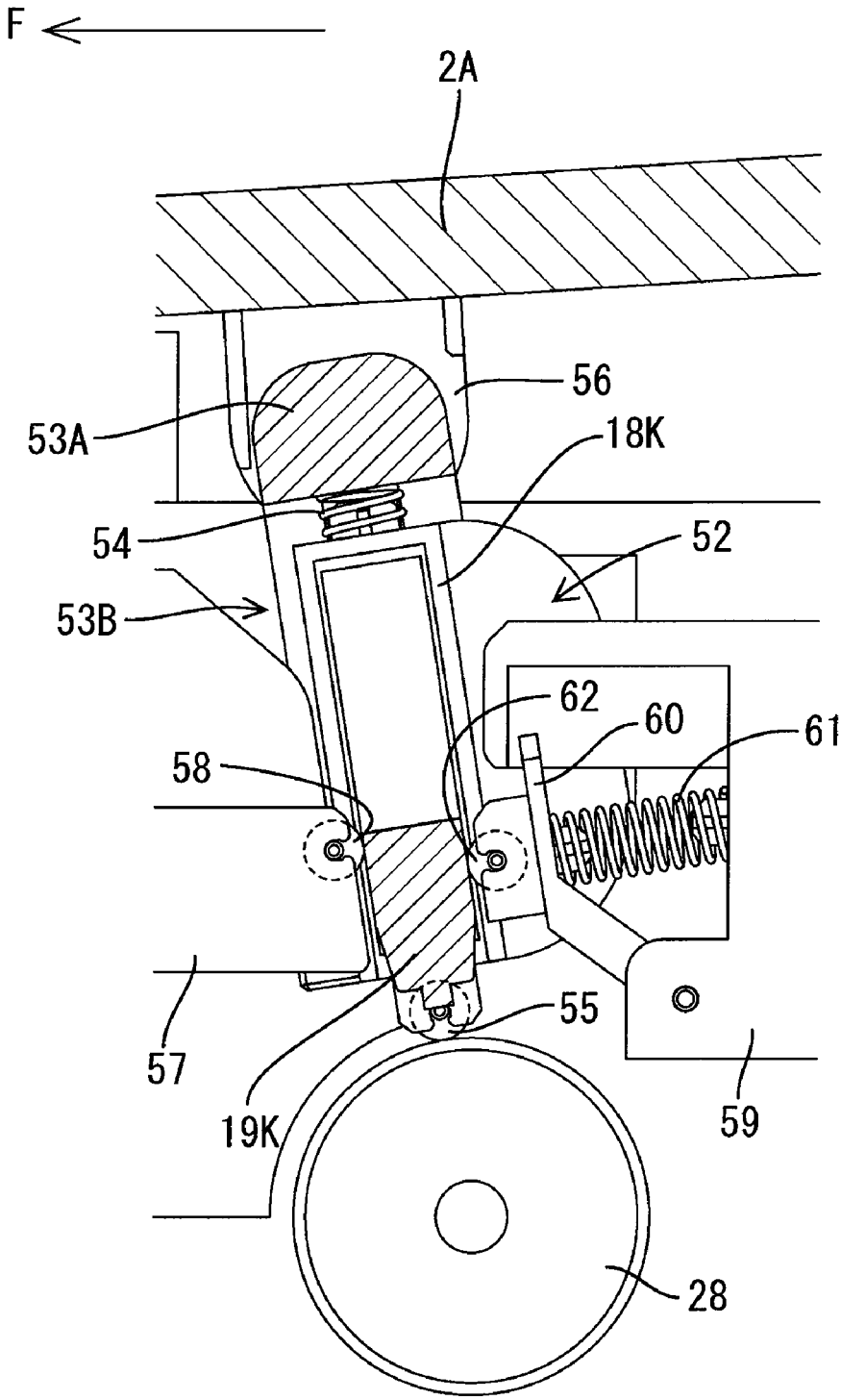
FIG. 4 is a side view showing of a guide mechanism.
Figure 5:
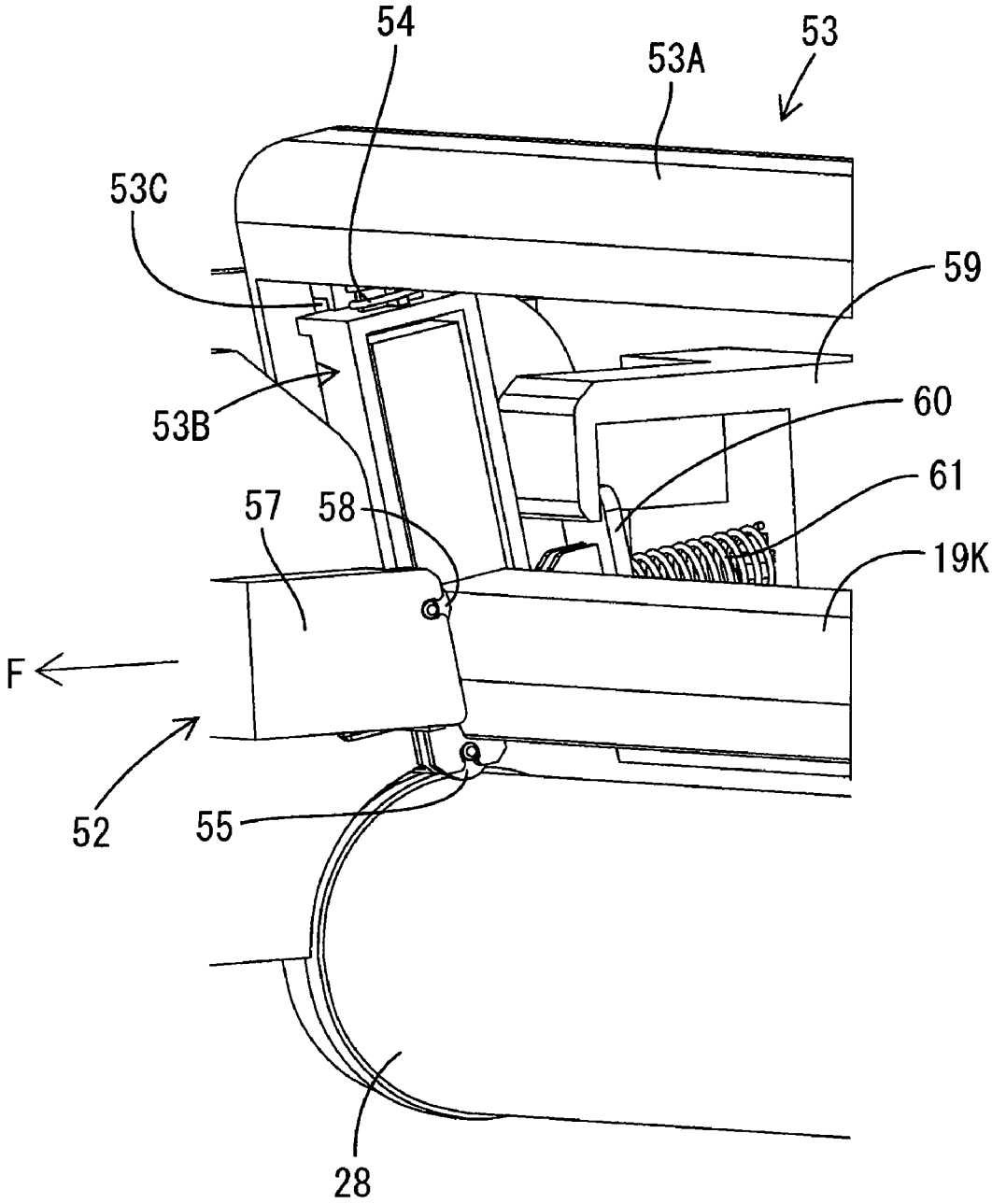
FIG. 5 is a perspective view showing the guide mechanism when viewed from the front.

FIG. 4 is a side view of one of the guide mechanisms 52, and FIG. 5 is a perspective view of the one of the guide mechanisms 52 when viewed from the front. Note that illustration of the guide mechanisms 52 is omitted in FIG. 1 and FIG. 2. Since the guide mechanisms 52 corresponding to the LED units 18K, 18Y, 18M and 18C are of the same structure, a description is given taking the guide mechanism 52 for the LED unit 18K as an example.

The LED unit 18K includes the LED head 19K and a holder 53. The holder 53 includes a connection portion 53A elongating in a left-and-right direction and arm portions 53B and 53B provided at the left and right ends of the connection portion 53A (only the left arm portion 53B is illustrated in FIG. 5). Left and right ends of the LED head 19K are respectively supported by the arm portions 53B and 53B. As shown in FIG. 4, the upper end part of the holder 53 is supported by the supporting member 56 to be rotatable with respect to the underside of the cover 2A. Accordingly, the lower end part of the holder 53 can swing about the upper end part thereof.

Each of the arm portions 53B has a slide mechanism 53C for vertically moving the LED unit 18K and an urging member 54, such as a spring, for urging the LED unit 18K toward the photosensitive member 28. A rolling element 55, such as a roller, is rotatably provided at the lower end of each arm portion 53. Since the rolling element 55 is kept in contact with the circumferential surface of the photosensitive member 28 at the longitudinal end of the photosensitive member 28 while being rotated following the rotation of the photosensitive member 28, the distance between the LED head 19K and the photosensitive member 28 can be maintained constant.

Each of the process cartridges 20 has two guide mechanisms 52 that are disposed proximate respective longitudinal ends of the photosensitive member 28. Each guide mechanism 52 includes guide members 57 and 59 for respectively guiding the front and rear sides of the LED unit 18K. The guide members 57 and 59 are configured to clamp the LED unit 18K therebetween. The guide member 57 is fixed to the development cartridge 22, and has a rolling element 58, such as a roller, at the rear end thereof. The rolling element 58 is brought into contact with the front side of the LED unit 18K. The guide member 59 has a movable member 60 movable forward and backward (in this embodiment, the movable member 60 is constructed as a pivotable arm pivotably movable forward and backward) and an urging member 61, such as a spring, for urging the movable member 60 toward the LED unit 18K. The guide member 59 further has a rolling element 62, such as a roller, rotatably supported to the movable member 60. The rolling element 62 is pressed onto the rear side of the LED unit 18K.

When closing the cover 2A, the LED unit 18K is inserted between the guide members 57 and 59, the rolling elements 58 and 62 maintain the LED unit 18K at a proper posture and guide the LED unit 18K toward the photosensitive member 28. When the cover 2A is completely closed, the rolling element 55 at the tip end of the LED unit 18K is brought into contact with the photosensitive member 28 by the urging force of the urging member 54. Accordingly, the LED unit 18K can be guided and positioned to establish a proper positional relationship with respect to the photosensitive member 28. Further, during the rotation of the photosensitive member 28, the proper positional relationship between the LED unit 18K and the photosensitive member 28 can be maintained cooperatively by the rolling members 55, 58 and 62.

4. IC Chip and IC Reader

In the present embodiment, as shown in FIG. 1, IC chips 50K, 50Y, 50M and 50C are secured to the development cartridges 22K, 22Y, 22M and 22C to face IC readers 15K, 15Y, 15M and 15C, respectively.

Figure 6:
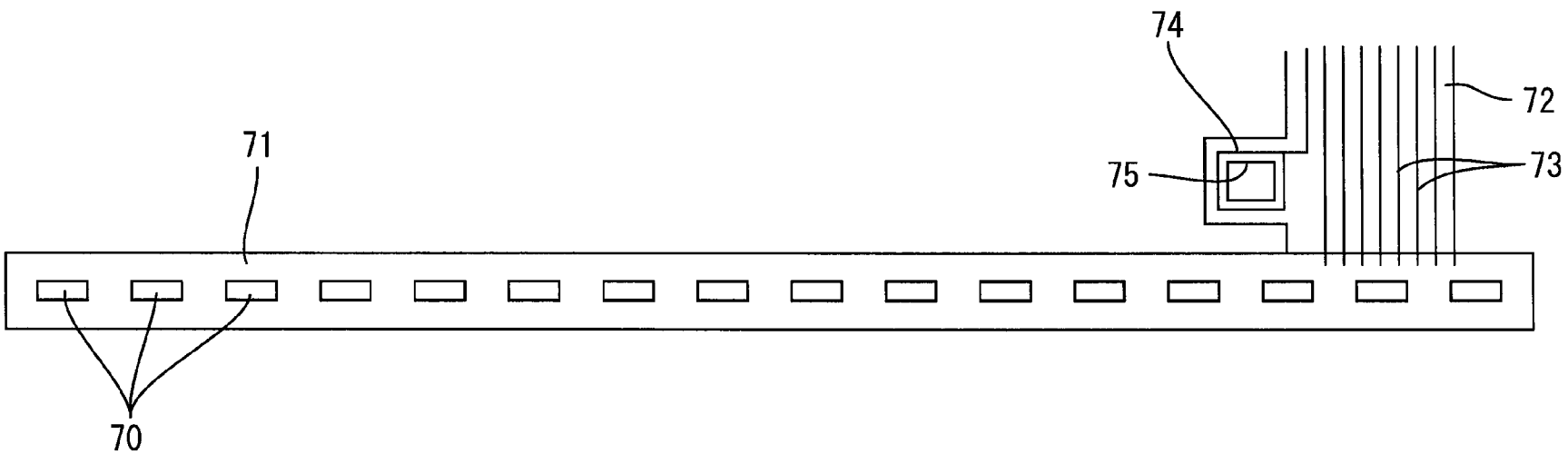
FIG. 6 is a schematic view showing an LED-mounted substrate.

In detail, the IC reader 15 is disposed on the front side of, for example, one of the arm portions 53B of the LED unit 18. As shown in FIG. 6, an LED-mounted substrate 71 on which plural LEDs 70 are arrayed in the left and right direction is provided in the LED head 19, and an FPC 72 (flexible printed circuit substrate, one example of a circuit substrate) extends from the LED-mounted substrate 71 for connection to a control circuit (not illustrated). The FPC 72 is formed with a drive signal path 73 to transmit drive signals for controlling light emission of the LEDs 70.

Further, the FPC 72 is formed with an antenna 74 of the IC reader 15. A through hole 75 is formed through the FPC 72, and the antenna 74 has an annular shape surrounding the through hole 75. The antenna 74 receives high frequency signals from the control circuit and induces a high frequency magnetic field to wirelessly receive cartridge information from the IC chip 50 upon.

The IC chip 50 is disposed on the rear side of the development cartridge 22 at a position facing the antenna 74.

5. Determining Process of Opening/Closing State of Cover and Mounting State of Development Cartridge The CPU 40 activates the IC readers 15K, 15Y, 15M and 15C, for example, upon receiving a print command by a user operating the operation unit 46, and attempts to read the cartridge information from the IC chips 50K, 50Y, 50M and 50C. If the cartridge information with respect to all of the development cartridges 22K, 22Y, 22M and 22C can be read without any problem, the cartridge information is reflected on a print process, etc.

The CPU 40 determines the opening/closing state of the cover and the mounting state of the development cartridge based on whether or not cartridge information could be read, for example, for at least one of the development cartridges 22K, 22Y, 22M and 22C. For example, when the cartridge information could not be read for a predetermined number or more of the development cartridges 22 adjacent to each other, the CPU 40 determines that the cover 2A is open. When the cartridge information could not be read for one specified development cartridge 22, the CPU 40 determines that the specific development cartridge 22 is not properly mounted, because this case would mean, for example, that the specific development cartridge from which the cartridge information could not be read does not exist in the printer or is obliquely mounted improperly. This configuration can dispense with any additional sensor dedicated to detect the opening/closing state of the cover 2A and the mounting state of the development cartridge 22.

6. Effects of the Present Embodiment (1) Since the printer 1 is of an electrophotography system, the positional relationship between the photosensitive member 28 and the development cartridge 22 is set at high accuracy in order to develop an electrostatic latent image on the photosensitive member 28. Further, since the printer 1 is of a non-laser type, the positional relationship between the LED unit 18 having LEDs 70 and the photosensitive member 28 is set at high accuracy by the guide mechanism 52 in order to realize exposure by the LEDs 70 the light intensity of which is comparatively weak. Consequently, the positional relationship between the development cartridge 22 and the LED unit 18 is set at high accuracy. Further, the development cartridge 22 is detachable from the casing 2 without adversely affecting the positional relationships described above.

Under these configurations meeting the highly accurate positional relationships described above, the printer 1 according to the present embodiment further includes the IC reader 15 mounted to the LED unit 18 for reading the cartridge information from the IC chip 50. Accordingly, it is possible to prevent the reading accuracy of the cartridge information stored in the IC chip 50 from being lowered while securing the positional relationship between the LED unit 18 and the photosensitive member 28 and achieving the detachability of the development cartridge 22.

(2) The printer 1 is configured so that the LED unit 18 is supported on the underside of the cover 2A. Further, the guide mechanism 52 is provided for guiding the LED unit 18 to establish the proper positional relationship between the LED unit 18 and the photosensitive member 28 when the cover 2A is closed. Therefore, it is effective to mount the IC reader 15 to the LED unit 18 in order to position the IC reader 15 close to the IC chip 50. Since the LED unit 18 having the IC reader 15 is moved to a position spaced from the development cartridge 22 when the cover 2A is open, the development cartridge 22 can be smoothly attached to and detached from the printer 1 even if the IC reader 15 is located close to the IC chip 50 when the cover 2A is closed.

(3) Further, since the antenna 74 of a non-contact type IC reader 15 is provided in the existing FPC 72, it is not required to provide a circuit substrate exclusive for the IC reader 15.

(4) The printer 1 is a color printer in which a plurality of development cartridges 22, photosensitive members 28 and LED units 18 are provided so as to correspond to the respective colors. Therefore, it is possible to prevent the reading accuracy of the cartridge information from being lowered while securing the positional relationship between each of the LED units 18 and a corresponding one of the photosensitive members 28 and achieving detachability of each of the development cartridges 22.

(5) Since the IC chip 50 and the IC reader 15 of the LED unit 18 are disposed to face each other, the distance between the IC chip 50 and the IC reader 15 can be made short to improve the reading accuracy.

Embodiment 2

Figure 7:
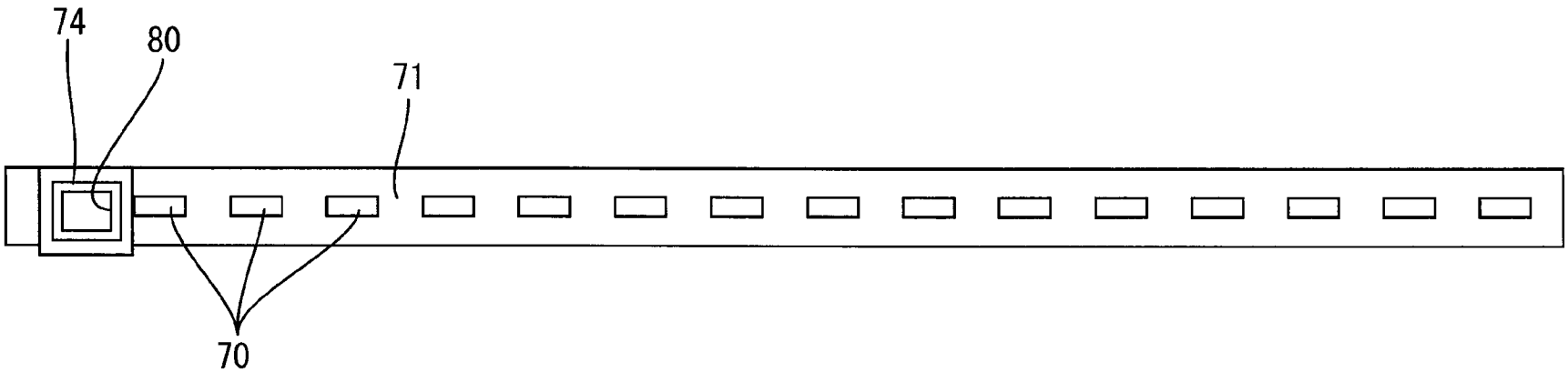
FIG. 7 is a schematic view showing an LED-mounted substrate according to Embodiment 2.

FIG. 7 shows Embodiment 2. A difference from Embodiment 1 described above resides in the location and configuration of the reader unit, and all the other portions are the same as those of Embodiment 1. Therefore, the components are given the same reference numerals, and overlapping description thereof is omitted. A description is given below of only the different points.

As shown in FIG. 7, an antenna 74 is provided on the LED-mounted substrate 71. A through hole 80 is formed at one end part of the LED-mounted substrate 71. The antenna 74 has an annular shape surrounding the through hole 80. The antenna 74 receives high frequency signals from the control circuit via a circuit pattern on the LED-mounted substrate 71 and induces a high frequency magnetic field to wirelessly receive cartridge information from the IC chip 50 upon.

Since the antenna 74 is provided on the LED-mounted substrate 71, it is not required to provide a circuit substrate exclusive for the antenna 74. The IC chip 50 is preferably located at one end side of the development cartridge 22 to be closer to the antenna 74.

Embodiment 3

Figure 8:
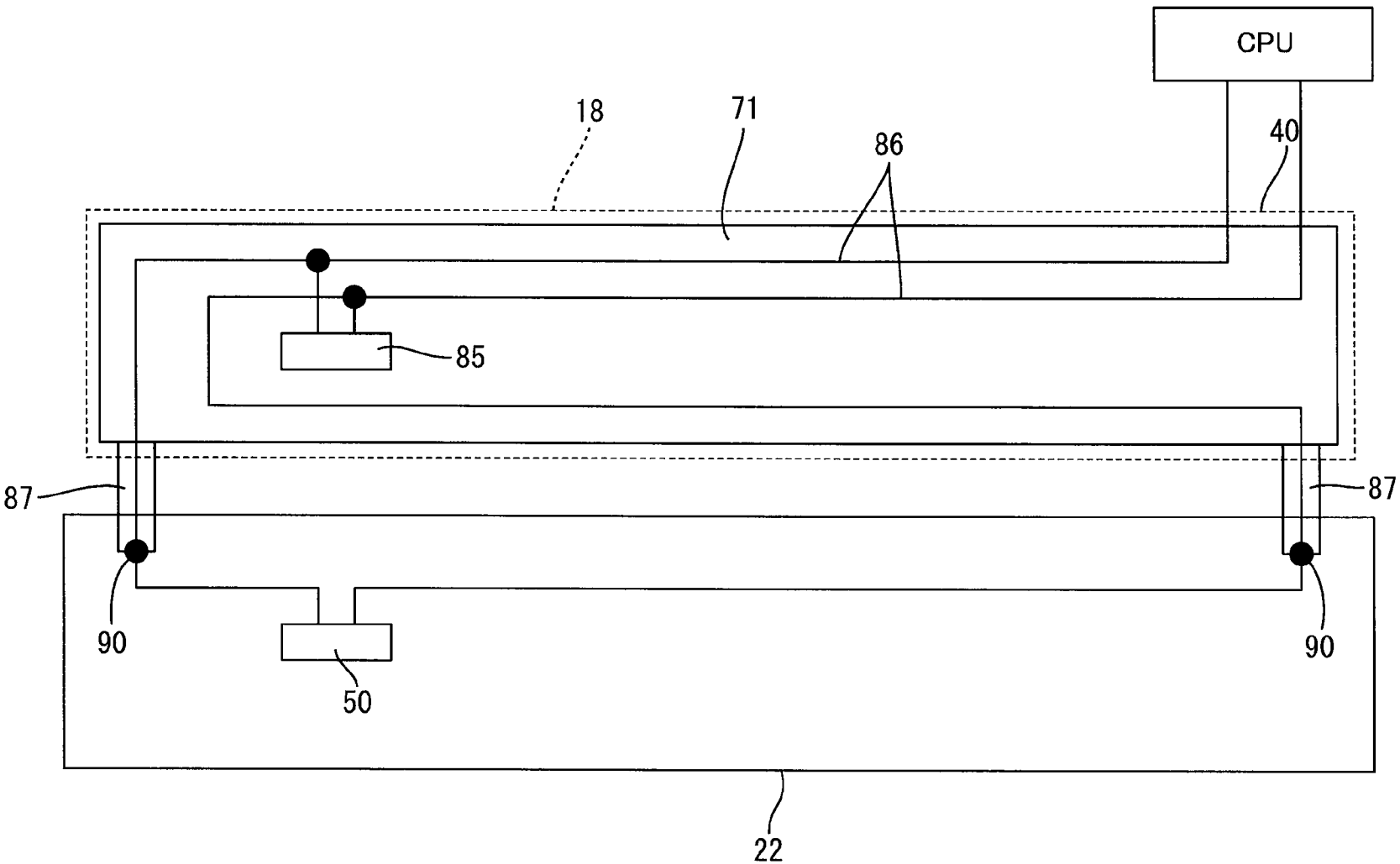
FIG. 8 is a schematic view showing an LED-mounted substrate according to Embodiment 3.
Figure 9:
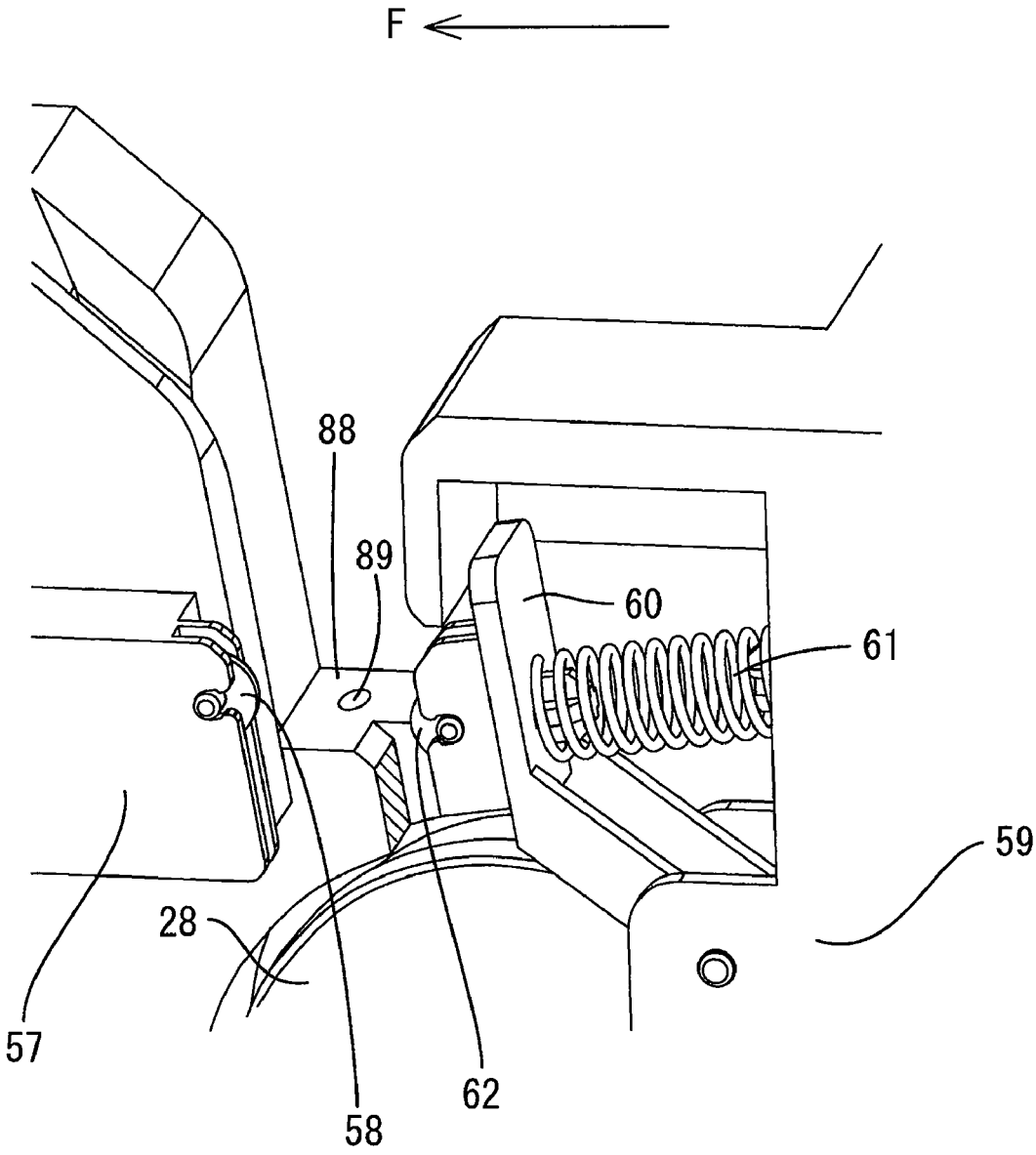
FIG. 9 is a perspective view showing the guide mechanism when viewed from above.

FIG. 8 and FIG. 9 show Embodiment 3. A difference from Embodiment 1 described above resides in the location and configuration of the reader unit, and all the other portions are the same as those of Embodiment 1. Therefore, the components are given the same reference numerals, and overlapping description thereof is omitted. A description is given below of only the different points. The LED 70 is omitted in FIG. 8. FIG. 9 is a perspective view of the guide mechanism 52 described above when viewed from above.

The LED-mounted substrate 71 has a memory 85 (for example, EEPROM, one example of a second memory) in which the LED information (one example of light emitting portion information) is stored. The memory 85 is electrically connected to the CPU 40 via an information signal path 86 formed on the LED-mounted substrate 71. The "LED information" includes the light emitting amount information of each of the LEDs 70 and the position information thereof. The CPU 40 reads the LED information from the memory 85, and controls the light emitting amount and light emitting timing of the LEDs 70 to correct unevenness in the light emitting amount and position among the LEDs 70.

Here, the IC reader (reader unit) according to the present embodiment is a contact type. As shown in FIG. 8, the LED unit 18 has metallic contact terminals 87 and 87 protruding outwardly. The contact terminals 87 and 87 are disposed at the left and right ends of the LED head 19 to be located outside the rolling elements 55, 58 and 62. The contact terminals 87 and 87 are electrically connected to the information signal path 86.

As shown in FIG. 9, the development cartridge 22 has flat portions 88, which are disposed at the left and right ends thereof to be located outside the rolling elements 58 and 62. Each of the flat portion 88 has an insertion hole 89 into which a respective one of the contact terminals 87 of the LED unit 18 can be fitted. Contacts 90 and 90 shown in FIG. 8 are respectively provided in the insertion holes 89. The IC chip 50 is electrically connected to these contacts 90 and 90.

When the contact terminals 87 of the LED unit 18 are fitted into the insertion holes 89 of the development cartridge 22 and electrically connected to the contacts 90, the CPU 40 can read cartridge information via the contact terminals 87 and the contacts 90. That is, the CPU 40 can read both cartridge information and LED information via the common information signal path 86. The CPU 40 can distinguish the cartridge information and the LED information one from another based on identification data added to the cartridge information and LED information, respectively. Each of the contact terminals 87 serves as a positioning pin for positioning the LED unit 18 with respect to the development cartridge 22, by being fitted into the insertion hole 89.

According to the present embodiment, utilizing the information signal path 86 for outputting the LED information to the outside of the LED unit 18, the cartridge information stored in the IC chip 50 can be output to the outside the LED unit 18. Therefore, the wiring of the signal path can be simplified. Further, the development cartridge 22 and the LED unit 18 can be positioned by utilizing the contact (connection) terminal 87.

Other Embodiments

The present invention is not limited to the embodiments described above with reference to the drawings and can be embodied in various ways. For example, at least the following embodiments are conceivable without departing from the sprit and scope of the present invention.

(1) Although the embodiments 1, 2 and 3 described above are configured so that the development cartridge 22 is integrally provided with the development roller 25, the present invention is not limited thereto. That is, the development roller may be independent from the development cartridge. For example, the development cartridge may be configured to have only the toner accommodation chamber 23 and positioned with respect to the independent development roller. Even in such a configuration, the positional relationship between the development cartridge and the development roller can be set at high accuracy to enable proper development, and therefore the positional relationship between the development cartridge and the exposure unit can be set at high accuracy via the development roller and the photosensitive member. Therefore, when the IC chip 50 is disposed on the development cartridge and the IC reader 15 or the contact terminal 87 is disposed on the exposure unit, effects similar to those of the above-described embodiments can be obtained.

(2) The above-described embodiments 1, 2 and 3 are configured so that the development cartridge 22 and the photosensitive member 28 are attached to and detached from the casing 2 as one unit, i.e. the process cartridge 20. Since the development cartridge 22 and the photosensitive member 28 are included in the process cartridge 20 in this configuration, the development cartridge 22 and the photosensitive body 28 are positioned at high accuracy. However, the present invention is not limited to this configuration. For example, the development cartridge 22 and the photosensitive member 28 may bee attached to and detached from the casing 2 independently of each other. Alternatively, the photosensitive member 28 may be fixed to the casing 2 and only the development cartridge 22 may be attached to and detached from the casing 2. Even in such configurations, since the development cartridge can be positioned with respect to the photosensitive member at high accuracy, effects similar to those of the above-described embodiments can be obtained.

(3) The above-described embodiments 1, 2 and 3 are configured so that, when the cover 2A is opened, the LED unit 18 is moved along with the cover 2A and the process cartridge 20 (development cartridge 22) is attached to and detached from the casing 2 in the up and down direction. However, the present invention is not limited thereto. For example, the LED unit 18 may be fixed to the casing 2, and the process cartridge 20 (the development cartridge 22) may be drawn out from the casing 2 in the left and right direction. In this case, since the LED unit 18 and the photosensitive member 28 can be set at a highly accurate positional relationship, effects similar to those of the above-described embodiments can be obtained by providing the IC reader 15 or the contact terminal 87 on the LED unit 18 and the IC chip 50 on the development cartridge 22.

(4) Although the printer 1 according to the above-described embodiments is constructed as a color printer including plural development cartridges 22, photosensitive members 28 and LED units 18 corresponding to the respective colors, the printer 1 may be constructed as a monochrome printer including one set of photosensitive member 28 and LED unit 18.

(5) The above-described embodiments 1 and 2 are configured so that the IC chip 50 and the IC reader 15 of the LED unit 18 are disposed to face each other. Since the reader unit, i.e. the IC reader 15 in the above-described embodiments 1 and 2, is of a non-contact type, the IC chip 50 and the IC reader 15 may be disposed not to face each other, or may be spaced from each other. However, even in the case of a non-contact type as in the embodiments 1 and 2, it is preferable to dispose the first memory (IC chip 50) and the reader unit (IC reader 15) close to each other. The reason is that if the distance between the first memory and the reader unit is long, it becomes required to use a reader unit having a wide reading range according to the distance. If so, there is a concern that the reader unit may read cartridge information not only from the first memory of the development cartridge of the corresponding color but also from a first memory of a development cartridge of another color not corresponding thereto, and it becomes required to add identification information to color-by-color cartridge information. Accordingly, even in the case of a non-contact type, it is preferable to dispose the first memory and the reader unit close to each other. By doing so, a reader unit having a narrow reading range can be used, and it is not required to add the identification information to the color-by-color cartridge information.

(6) The above-described embodiments 1, 2 and 3 are configured so that the exposure unit includes LEDs (light-emitting diodes). The present invention is not limited thereto. For example, the exposure unit may be configured to have a number of EL (electro-luminescence) elements or fluorescent elements as light emitting elements that are arrayed to selectively emit light according to image data. Alternatively, the exposure unit may be configured to have a number of liquid crystal elements or PLZTs as optical shutters that are arrayed to control light from a light source by selectively controlling the opening/closing time of the optical shutters according to image data.

What is claimed is:

1. An image forming apparatus, to which a development cartridge is configured to be detachably mounted, the development cartridge having a first memory storing therein cartridge information, the image forming apparatus comprising:

an apparatus casing having a cover;

an exposure unit having plural light emitting portions, the exposure unit being supported by the apparatus casing so that the light emitting portions face a photosensitive member rotatably supported by the apparatus casing;

a reader unit disposed on the exposure unit and configured to read the cartridge information from the first memory when the development cartridge is mounted to the image forming apparatus; and a determining unit configured to determine both of an opening/closing state of the cover and a mounting state of the development cartridge based on whether or not the reader unit can read the cartridge information, wherein the exposure unit is a light emitting diode unit and the light emitting diode unit is attached on the cover.

2. The image forming apparatus according to claim 1, wherein the apparatus casing includes an opening portion, through which the development cartridge is configured to be detachably mounted to the image forming apparatus, the cover is configured to open and close the opening portion, and the exposure unit is supported by the cover.

3. The image forming apparatus according to claim 1, wherein the reader unit includes a non-contact type reader unit having an antenna for wirelessly reading the cartridge information from the first memory, and the antenna is disposed on a circuit substrate having a drive signal path for the light emitting portions.

4. The image forming apparatus according to claim 1, wherein the reader unit includes a non-contact type reader unit having an antenna for wirelessly reading the cartridge information from the first memory, and the antenna is disposed on a circuit substrate having the light emitting portions.

5. The image forming apparatus according to claim 1, wherein the reader unit includes a contact type reader unit having a connection terminal electrically connectable to the first memory, the exposure unit has a second memory storing therein light emitting portion information, and an information signal path connected to the connection terminal and the second memory, and the exposure unit is configured so that the cartridge information of the first memory and the light emitting portion information of the second memory are output via the information signal path.

6. The image forming apparatus according to claim 5, wherein the connection terminal is contactable with the development cartridge to position the development cartridge relative to the exposure unit.

7. The image forming apparatus according to claim 1, wherein plural number of the development cartridges, the photosensitive members and the exposure units are provided to correspond to respective colors.

8. The image forming apparatus according to claim 1, wherein the reader unit is disposed to face the first memory.

9. An image forming apparatus, to which a development cartridge is configured to be detachably mounted, the development cartridge storing therein cartridge information, the image forming apparatus comprising an apparatus casing having a cover;

an exposure unit having plural light emitting portions, the exposure unit being supported by the apparatus casing so that the light emitting portions face a photosensitive member rotatably supported by the apparatus casing;

a reader unit disposed on the exposure unit and configured to read the cartridge information from the development cartridge when the development cartridge is mounted to the image forming apparatus;

a processor; and a memory storing machine readable instructions that, when executed by the processor, cause the image forming apparatus to determine both of an opening/closing state of the cover and a mounting state of the development cartridge based on whether or not the reader unit can read the cartridge information.

* * * * *